US006169360B1

(12) United States Patent
Tanno et al.

(10) Patent No.: US 6,169,360 B1
(45) Date of Patent: Jan. 2, 2001

(54) X-RAY IMAGE INTENSIFIER AND METHOD FOR MANUFACTURING THEREOF

(75) Inventors: Kazutoshi Tanno, kuroiso; Yoshinobu Sekijima; Hitoshi Yamada, both of Ohtawara; Takashi Noji, Tochigi-ken, all of (JP)

(73) Assignees: Kabushiki Kaisha Toshiba; Toshiba Electronic Engineering Corporation, both of Kawasaki (JP)

( * ) Notice: Under 35 U.S.C. 154(b), the term of this patent shall be extended for 0 days.

(21) Appl. No.: 09/068,453

(22) PCT Filed: Sep. 18, 1997

(86) PCT No.: PCT/JP97/03298

§ 371 Date: Jul. 17, 1998

§ 102(e) Date: Jul. 17, 1998

(87) PCT Pub. No.: WO98/12731

PCT Pub. Date: Mar. 26, 1998

(30) Foreign Application Priority Data

Sep. 18, 1996 (JP) ..... 8-246424
Feb. 5, 1997 (JP) ..... 9-022571

(51) Int. Cl.[7] ..... H01J 31/49; H01J 31/50

(52) U.S. Cl. ..... 313/530; 313/525; 313/527; 313/541; 250/214 VT

(58) Field of Search ..... 313/523, 525, 313/527, 530, 539, 541, 542, 543; 361/62, 121, 124, 137, 138; 250/214 VT

(56) References Cited

U.S. PATENT DOCUMENTS 4,847,482 * 7/1989 Kubo ..... 313/525 X
5,045,682 * 9/1991 Ono et al. ..... 313/525 X

* cited by examiner

*Primary Examiner*—Ashok Patel
(74) *Attorney, Agent, or Firm*—Oblon, Spivak, McClelland, Maier & Neustadt, P.C.

(57) ABSTRACT

The present invention assures a satisfactory adhesiveness of an input screen 13 of an X-ray image intensifier, high resolution of an output image and brightness uniformity as required, by configuring an aluminum or aluminum alloy substrate 21 so to have a concave surface with minute irregularities of the substrate material removed by burnishing, excepting gentle irregularities 21*c* without directivity which are caused by pressing. The gentle irregularities 21*c* of the substrate 21 preferably have an average length L in a range of 50 μm to 300 μm between the neighboring bottoms and an average height H in a range of 0.3 μm to 4.0 μm from peaks to bottoms. The invention improves resolution with light on the substrate surface suppressed from being scattered, and decreases image noises which are caused by the minute irregularities.

15 Claims, 16 Drawing Sheets

X-RAY IMAGE INTENSIFIER AND METHOD FOR MANUFACTURING THEREOF

FIELD OF THE INVENTION

This invention relates to an X-ray image intensifier and its production method for manufacturing thereof, and more particularly to a substrate on which an input screen is formed and its production method.

BACKGROUND OF THE INVENTION

An X-ray image intensifier, which is an electron tube for converting an X-ray image into a visible image or an electrical image signal, is being used in various fields such as medical and industry. As shown in FIG. 20, such an X-ray image intensifier comprises a spherical substrate 12 which forms a part of a vacuum envelope 11 and also serves as an input window, an input screen 13 which converts an X-ray image formed on the inner face of the substrate 12 into an electron image, a plurality of focusing electrodes 14*a*, 14*b*, 14*c* and anode 14*d* which configure an electron lens, and an output screen 15 which converts the electron image into a visible image.

The substrate 12 is generally aluminum or aluminum alloy (simply called aluminum) which has good X-ray permeability. The input screen 13 includes a layer of optically reflective layer 16 deposited on the substrate, a phosphor layer 17 which is formed of an aggregate of columnar crystals deposited on the layer of optically reflective layer 16, an optically transparent intermediate layer 18 adhered onto the phosphor layer 17, and a photocathode 19.

An X-ray image externally entered through the substrate 12 is emitted and converted into an electron image by the input screen 13, focused by an electron lens system, and converted into a visible image or an electric image signal by an output screen 15. The output visible image is transmitted to an X-ray TV camera or spot camera through the optical lens (not shown) positioned behind it and shown on a CRT monitor or the like by electrical image processing.

Meanwhile, in the recent X-ray image photography technology, higher resolution and brightness uniformity is demanded to be improved. Specifically, in this field, an image contrast is enhanced by the image integration processing or the like, and for example, defects on an output image due to minute scratches, stains or many etch pits or minute holes on the substrate surface due to etching are enhanced undesirably, and image noises which cannot be disregarded are caused.

According to the study made by the inventors, main causes of such image noises are assumed to be minute irregularities such as rolling lines caused when the substrate material is rolled and etch pits caused by etching for cleaning. Specifically, the surface of the substrate immediately be fore the input screen is formed was observed through a microscope to find irregularities having parallel directivity seemingly due to the rolling lines caused when the substrate material was rolled, countless irregular minute irregularities that the substrate material has originally and countless irregularities 12*a* such as etch pits as schematically shown in FIG. 21.

And, the conventional substrate surface having minute irregularities and the input screen formed on it has a part of light emitted on the phosphor layer 17 excited by X-rays entered sent to the substrate 12 and reflected in irregular directions as indicated by an arrow Y due to the countless irregularities 12*a* on the substrate surface or the surface of the layer of optically reflective layer (not illustrated).

The reflected light has its part returned into the same columnar crystal P where the light is emitted from, but another part enters another columnar crystal P next to the former columnar crystal P in the horizontal direction. Therefore, a possibility that the reflected light returns into the same columnar crystal is decreased as the surface of the substrate gets rougher, and resolution of an output image is degraded, and image noises are produced. And, if many etch pits are formed on the substrate surface by etching, very small pits are covered with the layer of optically reflective layer, while relatively large pits appear as spotted noises on the output image, and the image quality is degraded.

The formation of the phosphor layer of the columnar crystals by forming it on the irregularities on the substrate surface or the polished substrate surface as a mirror is disclosed in, for example, Japanese Patent Publication No. Sho 52-20818, its corresponding U.S. Pat. No. 3,473,066, U.S. Pat. No. 3,852,133, Japanese Patent Laid-Open Publication No. Sho 55-150535, Japanese Patent Laid-Open Publication No. Sho 57-82940, Japanese Patent Laid-Open Publication No. Hei 4-154032, and WO-94/22161.

But, most of them relate to a technology of forming regular pits and projections on the substrate surface and growing phosphor crystals depending on the pits and projections. They also relate to a technology of enhancing resolution by making the substrate surface flat and a mirror face to suppress the irregular reflection of the emitted light thereon. But, when the substrate surface is flat and mirror-like, the resolution is improved, but the adhesiveness of the input screen tends to be insufficient. Therefore, among the technologies described above, those practically used are not many.

The present invention was achieved in view of the circumstances described above and aims to provide an X-ray image intensifier which provides an input screen with sufficient adhesiveness, output image noises decreased and good resolution, and its production method.

DETAILED DESCRIPTION OF INVENTION

Figure 1:
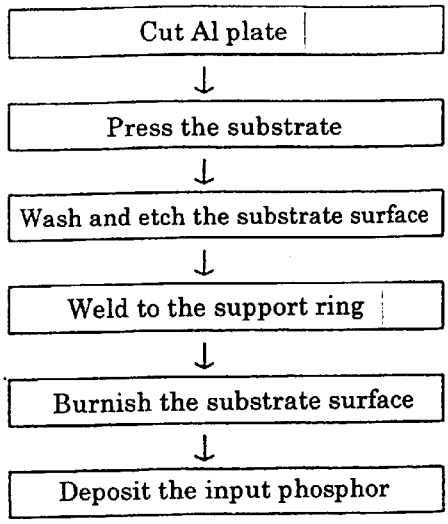
FIG. 1 is a block diagram showing one embodiment of a production process according to the invention.

To assure sufficient adhesiveness of an input screen, high resolution of an output image and brightness uniformity as required, the invention relates to an X-ray image intensifier which features a surface having minute irregularities removed or reduced and possessing moderate irregularities of an appropriate size as the surface of a substrate configuring the input screen. The moderate irregularities of this substrate surface preferably have ups and downs irregularly formed with a pitch several times greater than an average crystal diameter of an input phosphor layer comprising an aggregate of columnar crystals.

Therefore, an object of the invention is to provide an X-ray image intensifier in which a concave side of an aluminum or aluminum alloy substrate pressed to have a substantially spherical shape, on which an input screen is formed, has gentle irregularities having substantially no directivity which are caused by the pressing, an average length between the neighboring bottoms of the gentle irregularities is in a range of 50 $\mu$m to 300 $\mu$m, and an average height from peaks to bottoms is in a range of 0.3 $\mu$m to 4.0 $\mu$m.

Another object of the invention is to provide an X-ray image intensifier in which the gentle irregularities on the concave side of the substrate formed by pressing have a ratio (L.ave/Rc) of an average length (L.ave, a unit of $\mu$m) between the neighboring bottoms to a radius of curvature (Rc, a unit of mm) of the concave side of the center region of the substrate in a range of 0.5 to 1.2.

Still another object of the invention is to provide an X-ray image intensifier in which the concave side of the substrate, on which the input screen is formed, has an irregular reflection rate higher on the periphery region than on the center region.

Further another object of the invention is to provide a method of producing an X-ray image intensifier, which comprises a pressing step for pressing an aluminum or aluminum alloy substrate material into a substantially spherical shape; a burnishing step for crushing minute projections of the concave side of the pressed substrate; and an input screen forming step for adhering a photocathode and an X-ray excited phosphor layer formed of an aggregate of columnar crystals to the concave side of the substrate directly or through another layer.

Since minute irregularities such as fine sharp irregularities and lines due to rolling are decreased on a concave side of the substrate on which the input screen is formed by the invention, light on the substrate surface is suppressed from scattering and resolution is improved. In addition, image noises caused by such minute irregularities are also decreased. And relatively smooth and gentle irregularities caused by pressing keep a satisfactory adhesiveness of the phosphor layer to the substrate and the concave side serves like a concave mirror, so that reflected light is easy to gather into an aggregate of columnar crystals located adjacent to one another on the same concave side. Accordingly, a modulation transfer function (MTF) of a spatial frequency region corresponding to a pitch of gentle irregularities is improved. For example, MTF of 20 lp/cm is improved by 20% to 30% than prior art.

Now, embodiments of the invention will be described according to a desired production process with reference to the drawings. Like parts are indicated by like reference numerals. First, a flattened material of aluminum or aluminum alloy is prepared as material for the substrate to form an input screen of an X-ray image intensifier.

As the material for the substrate, which is disposed in a state no atmospheric pressure is directly applied, within a vacuum vessel of the X-ray image intensifier, pure aluminum having a purity of 99% or more in No. 1000s of JIS (Japanese Industrial Standard) can be used because the substrate itself may not have very high strength. For example, a JIS No. 1050 plate having a purity of 99.5% or higher is suitable.

Meanwhile, the X-ray image intensifier, having a structure that the substrate also serves as an input window a part of vacuum envelope, is now used extensively in view of a conversion efficiency and high resolution. The substrate in such a case is required to resist the atmospheric pressure, and since the inner face of the substrate substantially becomes a photocathode of an electron lens system, it is essentially required to be formable into a conforming concave side shape and not to deform undesirably.

Such a material for the substrate, which also serves as the input window of the vacuum envelope, is a high-strength aluminum alloy. For example, a aluminum alloy of No. 5000s or 6000s of JIS is suitable. Among others, a JIS No. 6061 aluminum alloy, a kind of Al—Si—Mg alloy materials, is particularly suitable. This aluminum alloy contains about 1.0 mass % of Mg, about 0.6 mass % of Si, about 0.25 mass % of Cu and about 0.25 mass % of Cr. And, a flattened material having been rolled to a thickness of about 0.5 mm and having a material designation code "O", namely indicating it was annealed, was mainly used in the embodiments to be described below. It is to be understood that such an aluminum alloy material can also be used, as the substrate to be disposed in a state that no atmospheric pressure is applied within the vacuum vessel.

First, the flattened material of aluminum alloy described above was cut into a circular plate having a diameter slightly larger than the outer diameter of the input window, so that it also serves as the input window, a part of vacuum envelope, of the X-ray image intensifier. Specifically, it is cut into, for example, a diameter of about 260 mm for a 9-inch X-ray image intensifier, i.e. 9 inch size model tube, a diameter of about 350 mm for a 12-inch intensifier, and a diameter of about 440 mm for a 16-inch intensifier, respectively.

The flat aluminum or aluminum alloy substrate material described above is used to prepare through the process shown in FIG. 1. Specifically, the substrate material is cut into a circular plate having a diameter slightly larger than the diameter of the input window, or an input screen-forming region, of the X-ray image intensifier. Then, it is pressed into a concave shape having a predetermined radius of curvature. It is then washed and etched. And the periphery of the substrate is tightly mated with a high-strength support ring. The input screen forming face of the substrate is then burnished. And the input screen such as phosphor layer is formed on the substrate surface and its interior is exhausted as a vacuum vessel to complete the X-ray image intensifier.

Figure 2A:
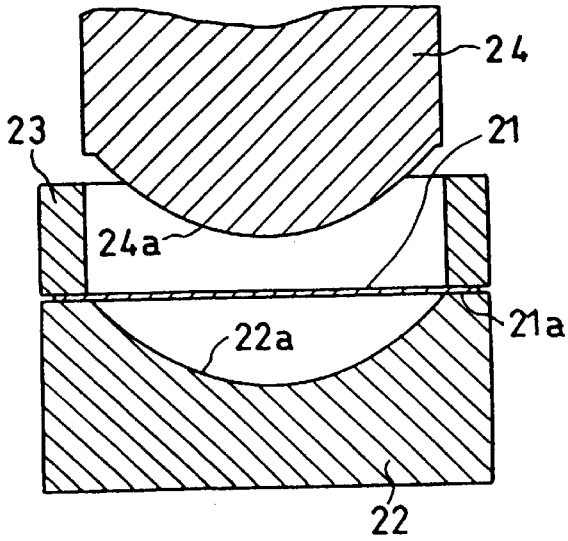
FIGS. 2*a*–2*b* are vertical sectional views showing a pressing process of a substrate according to the invention.
Figure 2B:
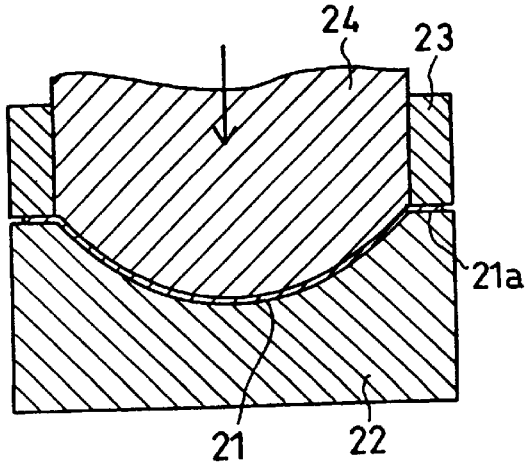

Now, the respective steps will be described. A flat material is cut into a circular plate, this circular plate 21 is placed on a lower die 22 of a press, its periphery 21*a* is held to be firmly constrained by a constraining die 23 as shown in FIG. 2(*a*), and it is pressed by lowering an upper punch 24 with a predetermined pressure at normal temperature to produce the concave substrate 21 as shown in FIG. 2(*b*). A press face 22*a* of the lower die 22 and a press face 24*a* of the lower die 22 have a predetermined radius of curvature and the surface finished similar to a mirror surface. The substrate 21 pressed as described above is degreased.

Figure 3:
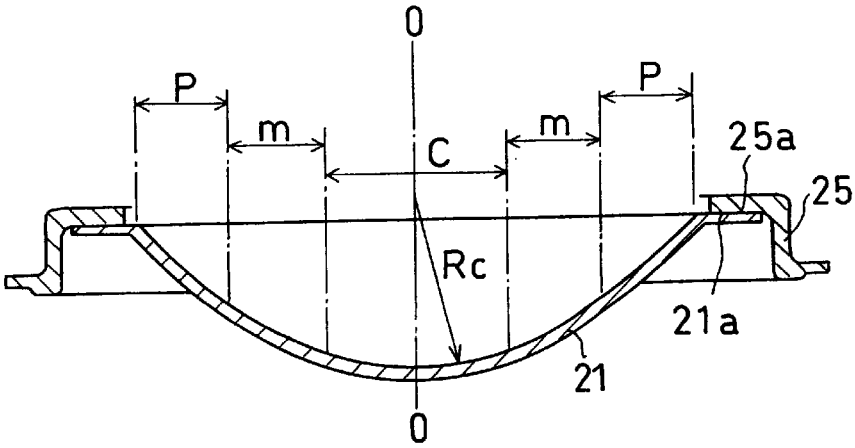
FIG. 3 is a vertical sectional view showing a state that a pressed substrate is joined to a support ring according to the invention.

And, to remove an oxidized film or the like, the whole surface of the substrate 21 is dipped to be etched in nitric acid for a moment. Then, as shown in FIG. 3, a joining face of the flange 21*a* of the substrate was tightly joined to a joining face 25*a* of a thick stainless steel support ring 25 by a local thermocompression bonding method or the like.

In this specification, a region from a center axis O of the substrate 21 to a periphery edge E of an arc face is radially divided into substantially three equal regions, namely they are defined as a center region c at the innermost section, a middle region m and a periphery region p at the outermost section. And the center region c has a radius of curvature Rc.

Figure 4:
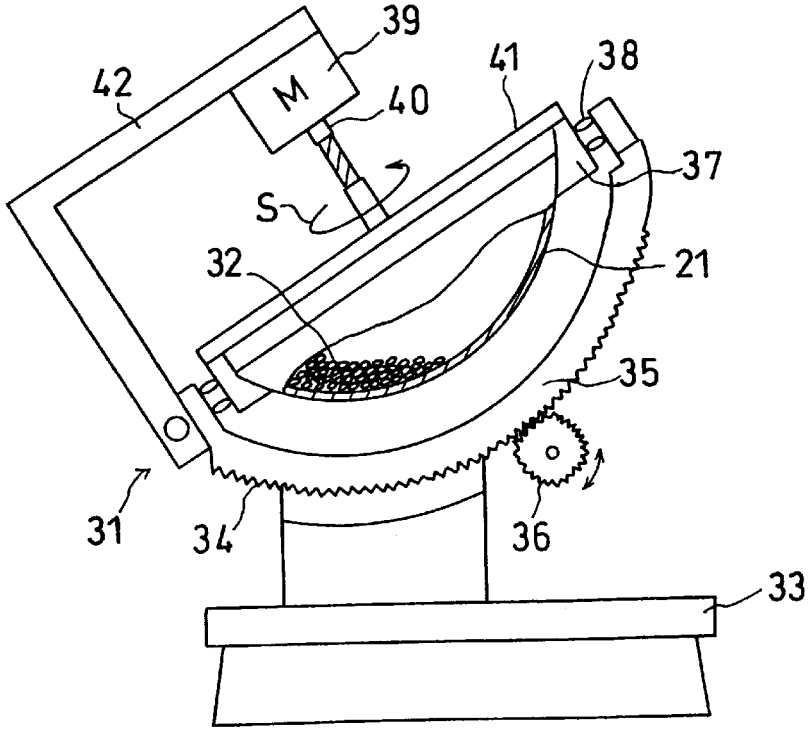
FIG. 4 is a schematically side view showing a processor used in a burnishing step according to the invention.
Figure 21:
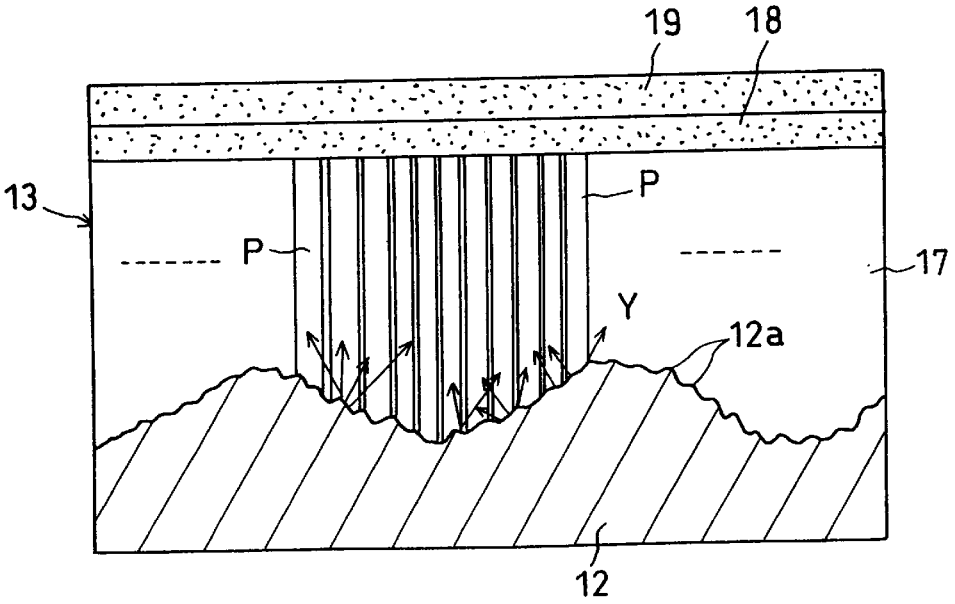
FIG. 21 is an enlarged view schematically showing main parts of a conventional substrate, input screen and its operation.

As shown in FIG. 21, at least the inner face of the substrate 21 has a number of minute irregularities due to rolling lines, etching or the like. Then, as shown in FIG. 4, the substrate 21 was fixed to a burnishing machine 31, a large number of microballs 32 was placed in the concave side of the substrate 21, and the substrate 21 was continuously rotated for a predetermined time to perform the burnishing treatment.

The burnishing is a fabricating method that for example microballs are rolled or another tool is pressed and slid on the subject face of the substrate to crush small projections on the surface and also fill recesses, thereby smoothing the surface. Therefore, this method does not shave to remove the projections on the subject surface of the substrate, so that substantially no micro cut scraps or shavings of the substrate material are produced by this method.

The burnishing machine 31 comprises a base 33 which also serves as vibrator, an inclination angle adjusting arm 35 having teeth 34 continuously arranged in a circular arc, a drive gear 36 for the arm 36, a substrate holder 37 for cramping the substrate, a bearing 38 for rotatably supporting the holder 37, a drive motor 39 for turning the substrate holder 37, a rotating shaft 40 of the motor 39, a rotating cover 41 which is connected to the shaft 40 to transmit a turning force and also a lid for the substrate, and a motor support arm 42. A similar device is disclosed in German Patent Laid-Open Publication No. 2435629 and can also be used in this invention.

In burnishing, the substrate 21 is fixed to the substrate holder 37 of the machine, and a predetermined quantity of microballs 31 is placed in the substrate 21. And, the rotating cover 41 integral with the motor 39 is placed to cover the substrate 21 and fixed to the substrate holder 37. The motor 39 is driven to rotate or turn the substrate 21 as indicated by an arrow S at a speed of about one turn per second, for example.

The microballs 32 are made of, for example, a metal material such as stainless steel or alumina ceramics, having Vickers hardness of two times or higher than the material of the substrate 21. And, the microballs 32 have an average diameter in a range of 0.3 mm to 3.0 mm and are truly round balls having a diameter of, for example, 1.0 mm. For example, in treating the substrate for 12-inch model, a plurality of alumina ceramics microballs 32 in a weight of about 500 g as the whole were placed, and the substrate was rotated for about 60 minutes. Thus, minute projections on the inner face of the substrate are gradually crushed by the rolling microballs, many etch pits are gradually filled accordingly, and gentle irregularities not having directivity produced by the pressing described above are smoothed as described afterward with the shape and dimensions remained substantially as they are.

In burnishing, a method of turning the substrate using a predetermined quantity of microballs is preferable because the shape of the subject substrate and the radius of curvature are not changed substantially. But, it is not limited to this method, but there may be used a means in that a contact is pressed to the substrate surface under an appropriate pressure not to deform the substrate and at least either of the substrate and the contact is moved to crush the minute projections on the substrate surface.

The inclination angle adjusting arm 35 is properly adjusted by the burnishing device 31 as required to continuously or stepwisely change the inclination of the rotation center shaft of the substrate 21, or vibrations are properly given by the vibrator to change a level of the burnishing treatment of the center region, middle region and periphery region of the substrate. Otherwise, a speed of inclining the inclination angle adjusting arm 35 is determined not constant but, for example, slowed as the inclination is increased, or the turning speed of the substrate by the motor 39 is decreased when the inclination angle is increased to gather the microballs mainly at the periphery region, thus a contact duration of the substrate surface and the balls per unit area for each subject region of the substrate surface can be changed as desired. Besides, the structure can be formed to give a desired motion so that the microballs are rolled, moved or scrubbed on the substrate surface.

After burnishing as described above, as shown in FIG. 5, an aluminum deposited layer as the layer of optically reflective layer 16 is formed to a thickness of, for example, about 3000 angstroms (A) on the inner concave side of the substrate 21. Since the minute projections are hardly shaved by the burnishing process above, undesired fine powder is not produced. Therefore, washing for removing such powder is not required. However, if fine powder is formed in a small amount as described in embodiments afterwards, dry or wet washing is performed.

Then, an input screen 13 is formed on the substrate surface. Specifically, a phosphor layer 17 made of cesium iodide (CsI) activated by, for example, sodium (Na) is formed on the layer of optically reflective layer 16 of the substrate surface by a known deposition method to have a columnar crystal structure having a thickness of, for example, 400 to 500 $\mu$m. An average of diameters d of the respective columnar crystals P of the phosphor layer 17 is in a range of about 6 to 10 $\mu$m, for example about 8 $\mu$m. An optically transparent intermediate layer 18 is formed on the phosphor layer formed of an aggregate of columnar crystals so to continue the end portions of the respective crystals. And, the support ring for the substrate is closely welded to another part of the vacuum envelope and mounted on an exhaust device to vacuum the interior, and a photocathode 19 is formed to complete the input screen 13. The layer 16 of optically reflective layer may be omitted but is useful to remedy a defect such as local stains on the whole face of the substrate.

Figure 5:
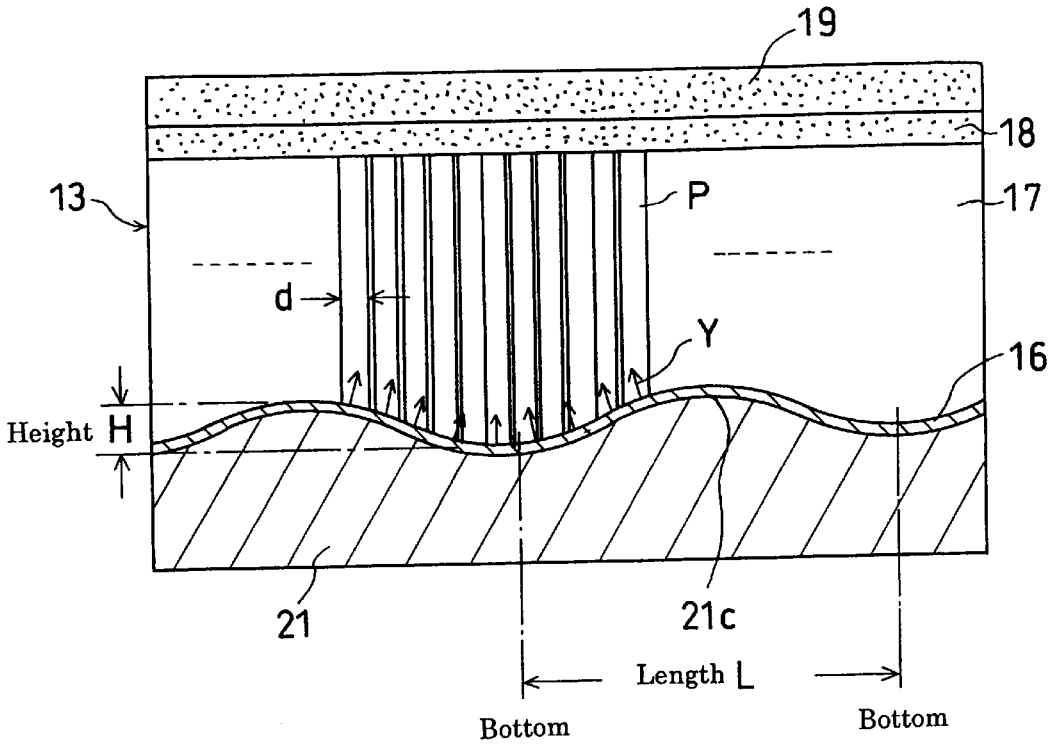
FIG. 5 is an enlarged sectional view schematically showing main parts of the construction of an input screen and its optical reflecting state according to the invention.

As shown in FIG. 5, according to the invention, the gentle irregularities 21*c* formed by pressing become smooth and remain as they are substantially on the face of the substrate 21 where the input screen is formed by burnishing, and the conspicuously seen minute irregularities (corresponding to the reference numeral 12*a* in FIG. 21) have been removed to substantially nil. Therefore, in the light emitted on the phosphor layer, light, which advances through the respective columnar crystals to and reflects on the substrate surface or the layer of optically reflective layer on the substrate surface, returns almost to the same columnar crystals to reach the photocathode. As a result, resolution can be improved.

The substrate surface which was confirmed its improved property in the embodiment of the invention was compared with a conventional one to confirm the following facts. Specifically, micrographs of various states of substrate surfaces are shown in FIG. 6(*a*) through FIG. 8(*f*)

Figure 6A:
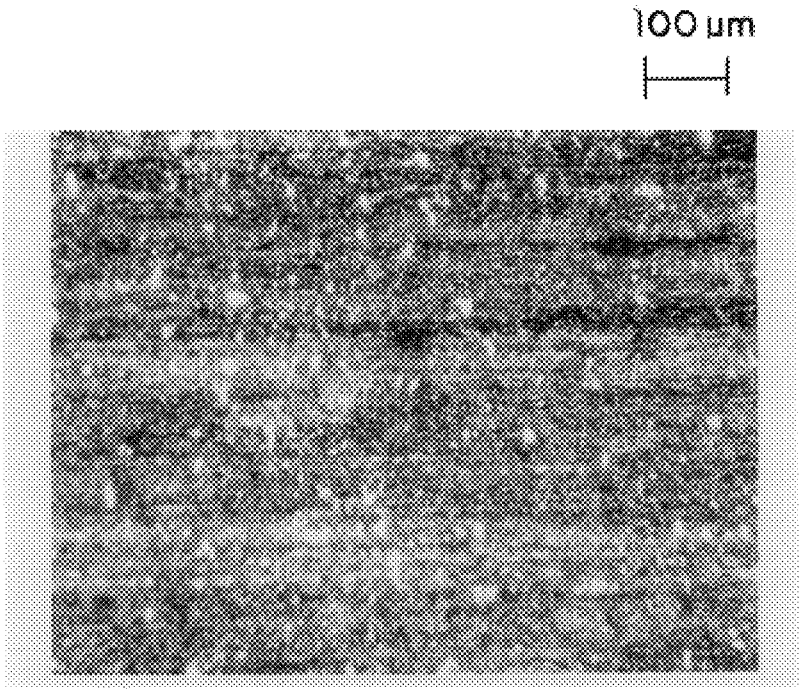
FIGS. 6*a*–6*b* show diagrams indicating in the form of a micrograph the surface conditions of a substrate material of the invention before and after pressing.
Figure 6B:
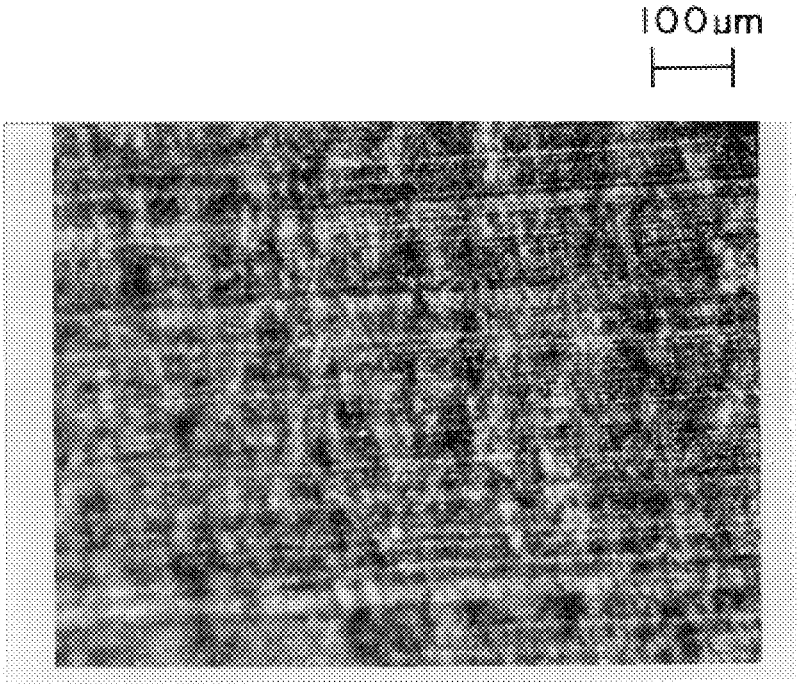

FIG. 6(*a*) is a micrograph with a magnifying power of about 100 times, showing the surface condition of the aluminum alloy (JIS No. 6061) plate material for a 9-inch model. It shows many linear irregularities extending in parallel to one another in a horizontal direction seemingly derived from rolling lines and also shading seemingly formed by irregular minute irregularities.

And FIG. 6(*b*) is another micrograph with the same magnifying power, showing the surface condition of the same plate as in the FIG. 6(*a*) after pressing. It shows many linear irregularities extending in parallel to one another in a horizontal direction, which are seemingly derived from rolling lines, also irregular minute irregularities, and in addition, irregular shading having a relatively large area. This irregular shading having a relatively large area seems formed due to gentle undulating irregularities caused by pressing as compared with a profile of irregularities to be described afterward.

Figure 7C:
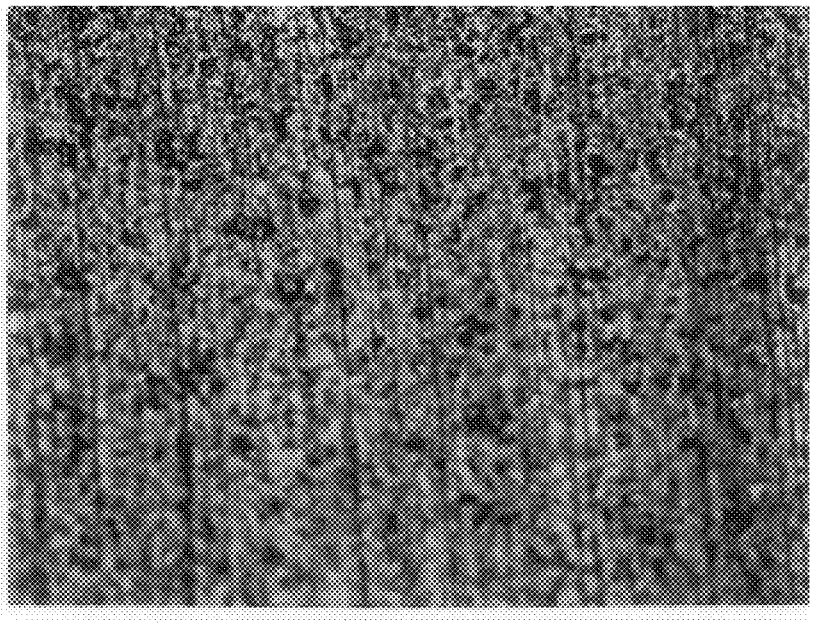
FIGS. 7*c* and 7*d* show diagrams indicating in the form of a micrograph the surface conditions of one embodiment of the substrate of the invention after etching and after burnishing.
Figure 7D:
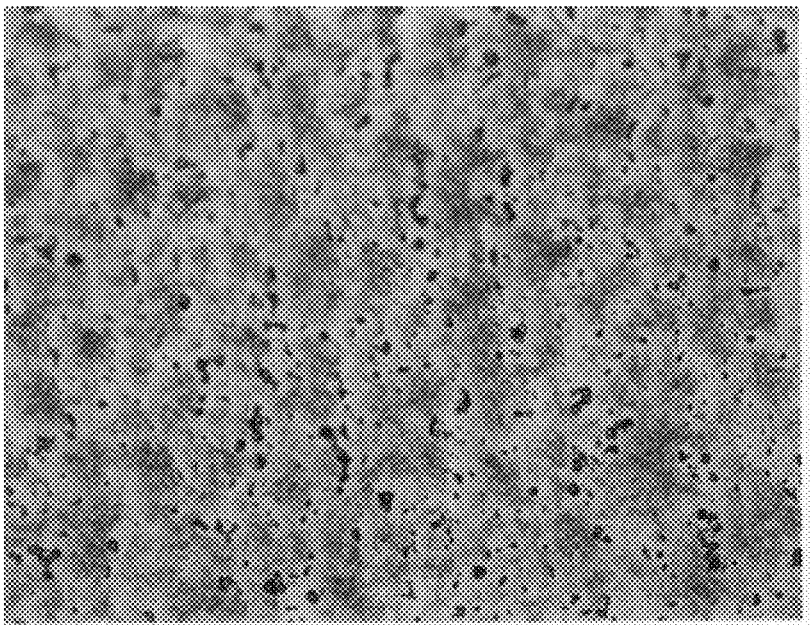

Then, the press-formed substrate, which was etched, had a surface condition as shown in FIG. 7(*c*). It is a micrograph with the same magnifying power as the above case. It is not easy to distinguish but there are irregularities extending in parallel to one another in a horizontal direction and seemingly derived from rolling lines and also irregular minute irregularities and many black spots having a small area are mixed therein.

The etched substrate was then burnished by the burnishing device described above for about 60 minutes. The burnished substrate had the face as shown in FIG. 7(*d*), which is a micrograph with the same magnifying power as above. It is seen that the irregularities due to rolling lines were removed to an extent that they can hardly be recognized and the irregular fine projections are substantially crushed to a smooth surface. Meanwhile, many of the etch pits are filled, but not a few filled etch pits remained are seen as black spots. And, several shades due to gentle undulating irregularities caused by pressing are seen.

Figure 8E:
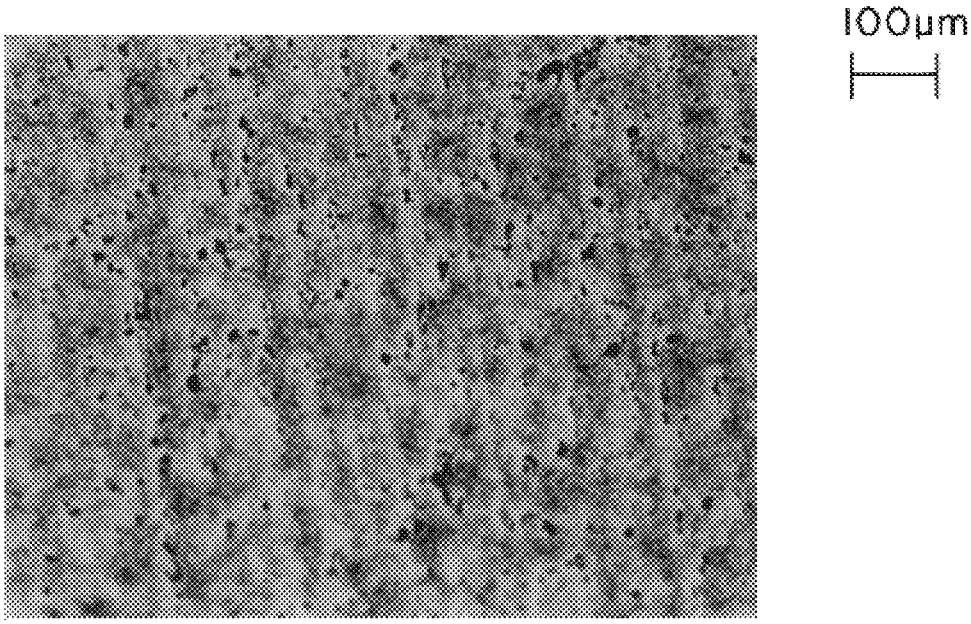
FIGS. 8*e* and 8*f* show diagrams indicating in the form of a micrograph the surface conditions of another embodiment of the substrate of the invention after burnishing.
Figure 8F:
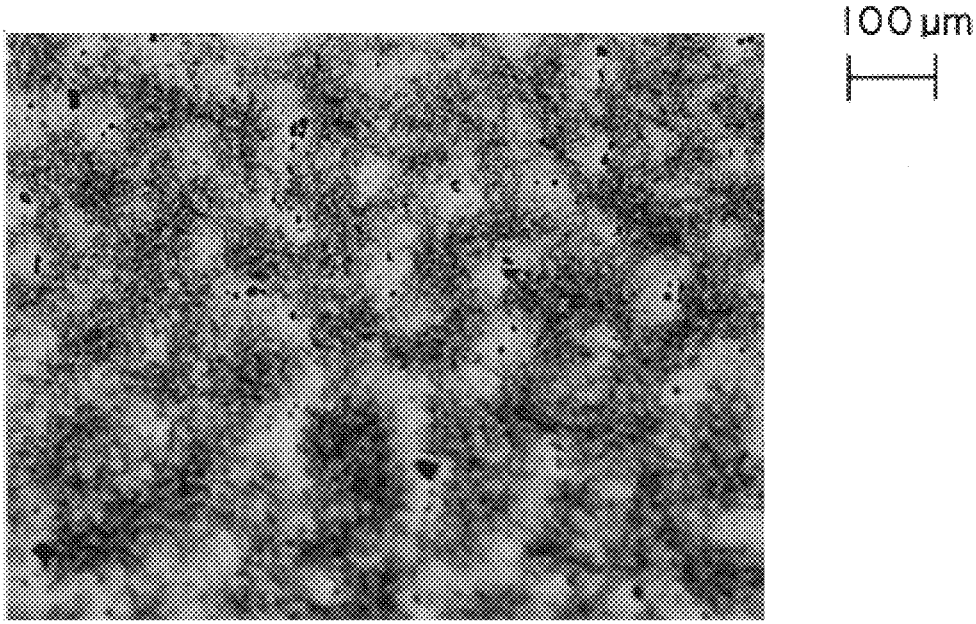

FIG. 8(*e*) is a micrograph with the same magnifying power as above, showing the face of another sample substrate undergone the burnishing process for about 60 minutes after the same process as described above. This sample has some irregularities remained seemingly due to rolling lines Furthermore, FIG. 8(*f*) is a micrograph with the same magnifying power as above, showing the surface of the substrate undergone the burnishing for about 180 minutes. It is seen that shading due to gentle irregularities remains and black spots of etch pits are decreased as compared with those shown in FIG. 7(*d*) and FIG. 8(*e*). Thus, it was confirmed that the gentle irregularities caused by pressing remain as they are as the burnishing process becomes long, the irregularities due to rolling lines and many irregular minute projections are crushed, and the etch pits are further filled.

As schematically shown in FIG. 5, the emitted light on the phosphor layer formed on the substrate having the surface condition as described above has its part hardly scattered on the substrate surface with substantially no minute irregularities and reflected to return into the same columnar crystals and advances to the photocathode. As a result, good resolution can be obtained. And, a good adhesiveness of the phosphor layer is kept by the gentle irregularities caused by pressing.

Irregularity profiles of the substrate surfaces were determined as shown in FIG. 9 through FIG. 15 by the tracer type surface roughness measurement specified by JIS. This measurement of irregularity profiles measures a range of 2 to 4 mm in a given linear direction in a given position of the center region c of the substrate. To measure the irregularities in the center region c of the substrate, a region not including the center axis portion where the material hardly flows by the pressing was actually measured.

Figure 9A:
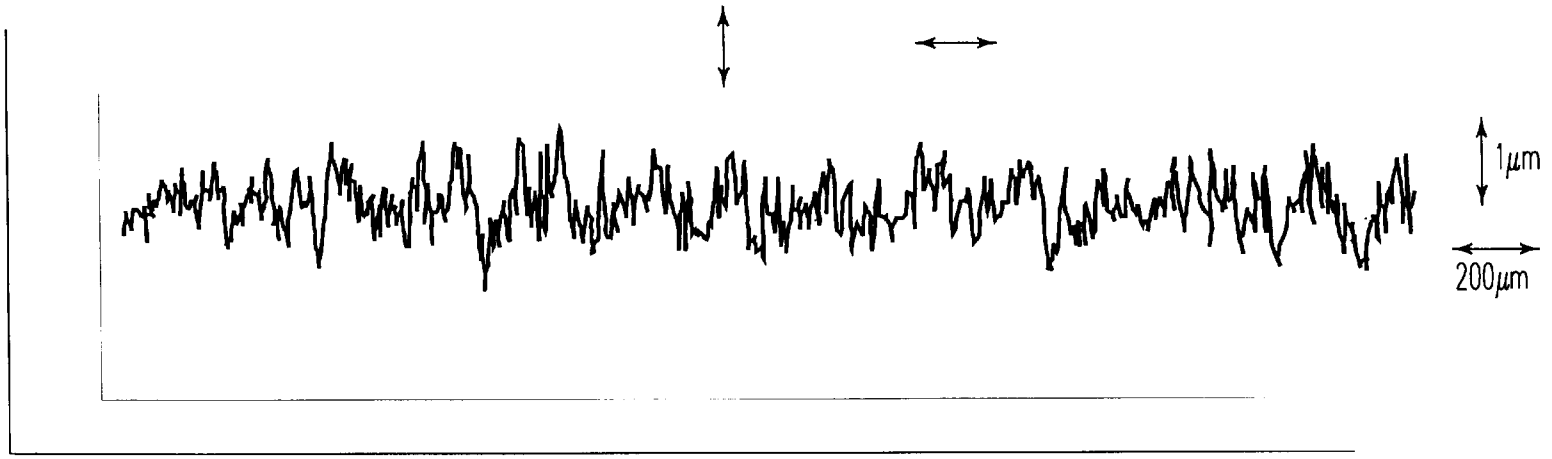
FIG. 9 shows graphs indicating the uneven surface profiles of a substrate material of the invention before and after etching.
Figure 9B:
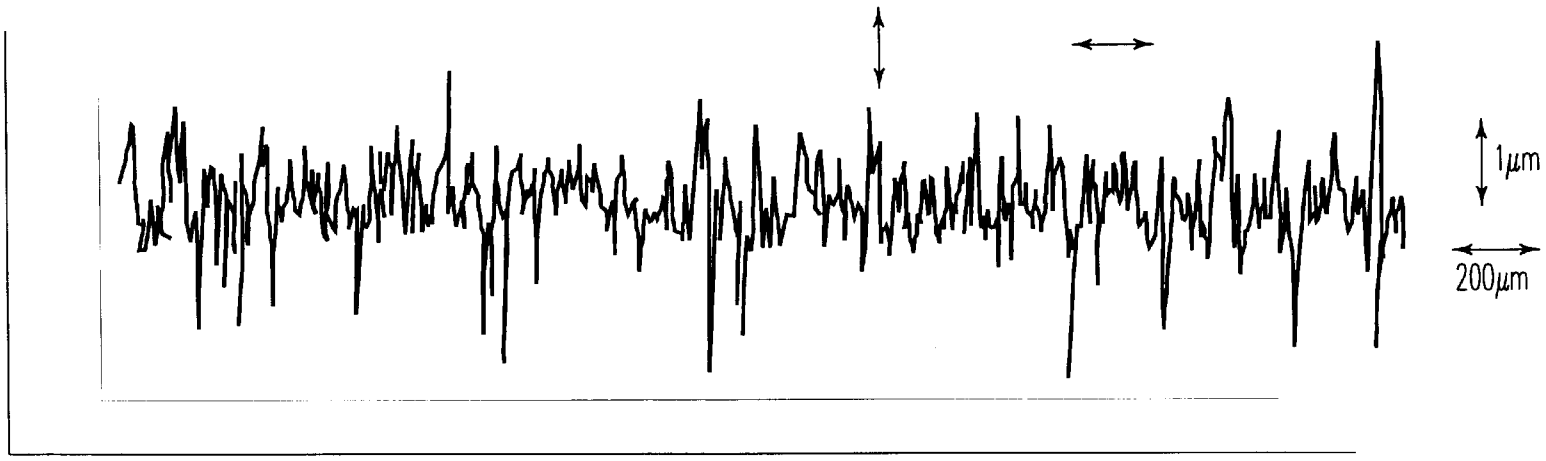

FIG. 9 (9A-*a*) shows a profile of irregularities measured in a direction substantially at right angles to a longitudinal direction of the rolling lines on the flat material before pressing a substrate for 9-inch intensifier tube. The horizontal axis indicates a position in the horizontal direction along the substrate surface, namely a distance (a magnification power of 50 times), and the vertical axis indicates a change in a vertical direction (a magnification power of 10000 times). The same is also applied to other profiles of irregularities. The profile of irregularities shown in this drawing corresponds to the substrate surface whose micrograph is shown in FIG. 6(*a*) It is seen from this profile of irregularities that countless minute irregularities including those due to rolling lines are on the substrate surface.

FIG. 9(9A-*b*) shows a profile of irregularities in the center region of the substrate which was prepared by pressing as the flat material for the same 9-inch model and etching for about 15 minutes. It corresponds to the substrate surface whose micrograph is shown in FIG. 7(*c*). It is seen from the profile of irregularities that the substrate surface in this state has countless minute irregularities with greater differences and many etch pits.

Figure 10A:
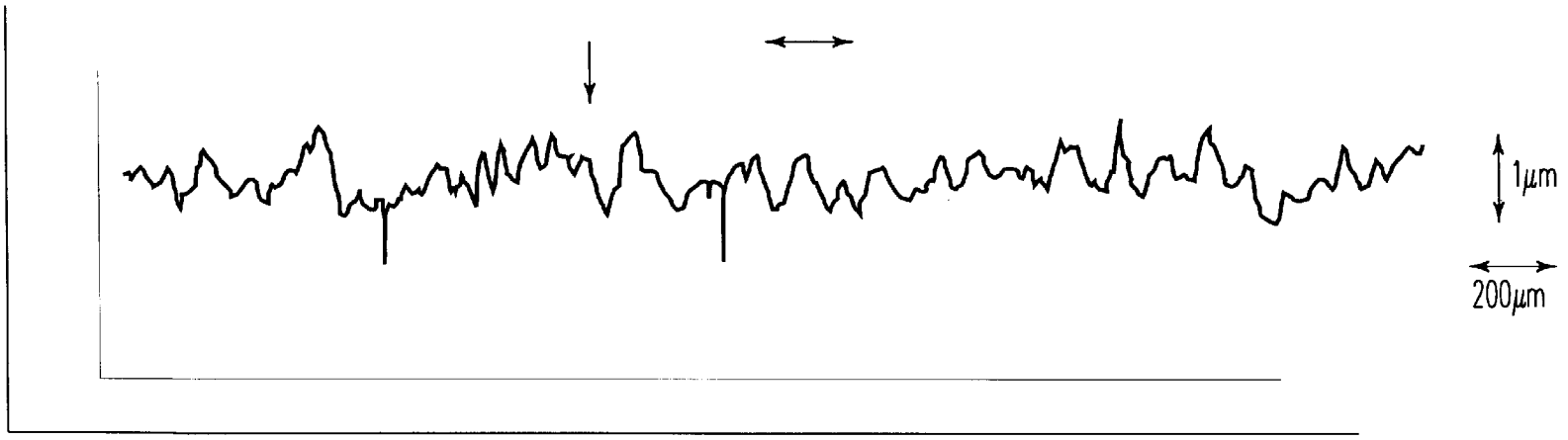
FIG. 10 shows graphs indicating the uneven surface profiles of a substrate of the invention after burnishing and after formation of a layer of optically reflective layer.
Figure 10B:
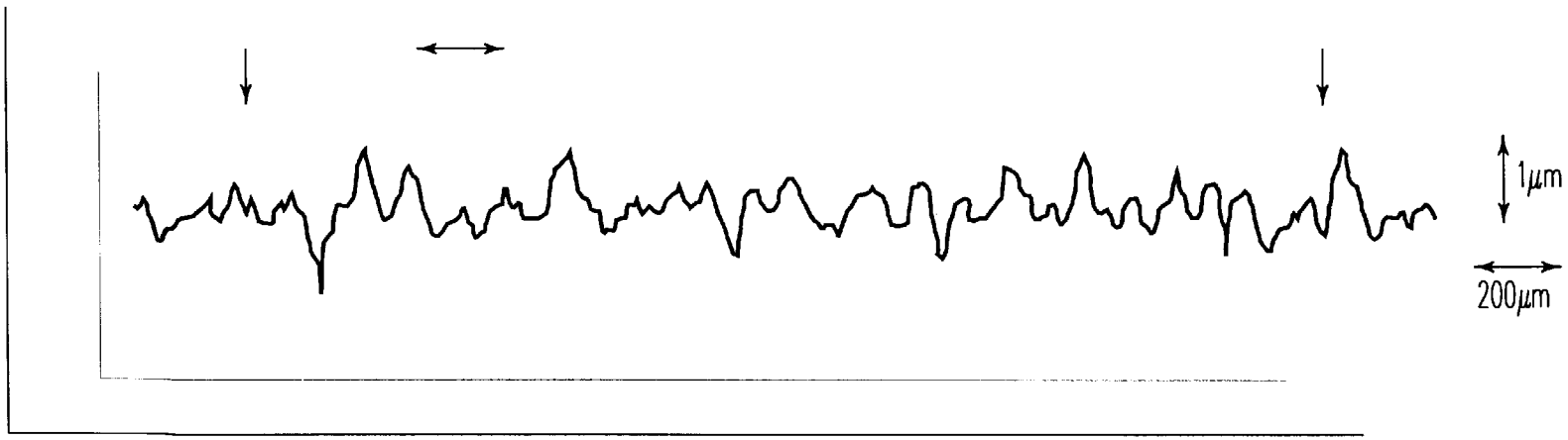

FIG. 10(9A60-*c*) shows a profile of irregularities on the center region of the substrate for the same 9-inch model, which was burnished for about 60 minutes. It corresponds to the substrate surface whose micrograph is shown in FIG. 7(*d*). It is seen from this profile of irregularities that the substrate surface in this state has gentle irregularities seemingly caused during the pressing process and the countless minute irregularities which was seen before the processing have disappeared substantially. And, pulse-like downward changes are seen locally, which were caused by a remaining small number of etch pits.

FIG. 10(9A-*d*) shows a profile of irregularities on the center region of the surface of layer which was prepared by depositing a layer of optically reflective layer of aluminum with a thickness of about 3000 angstroms on the substrate surface undergone the burnishing for the same 9-inch model. It is seen from this profile of irregularities that the gentle irregularities caused in pressing are smoothed and appear substantially as they are in the same irregular size on the substrate surface in this state and the etch pits are filled almost completely. Besides, it is also seen from this profile of irregularities that the gentle irregularities and fine irregularities appear as they are on the burnished substrate surface even if it had the layer of optically reflective layer of aluminum deposited to a thickness of about 3000 angstroms.

Figure 11A:
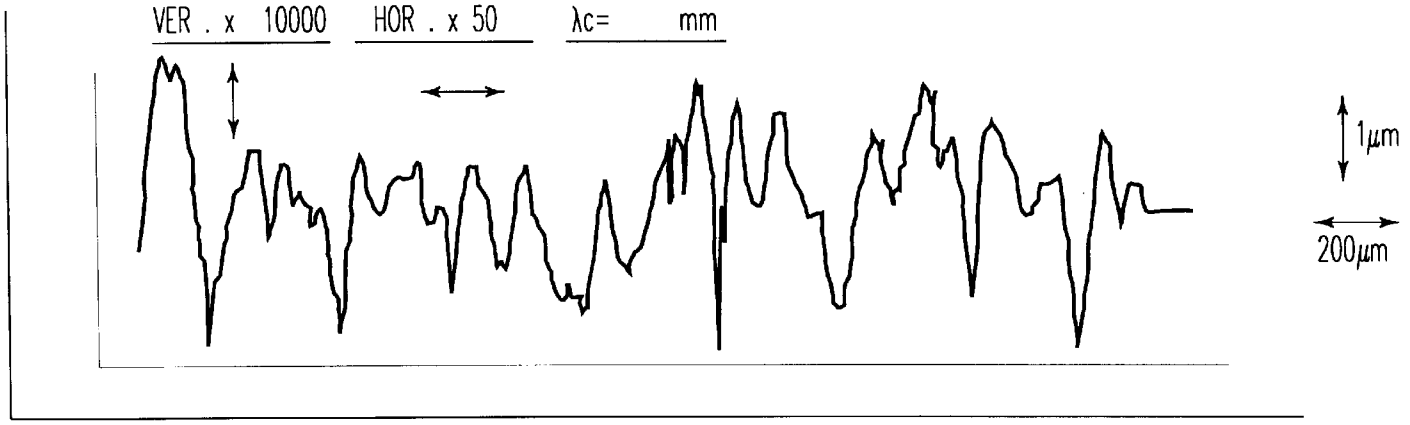
FIG. 11 shows graphs indicating the uneven surface profiles of another embodiment of the substrate of the invention after burnishing and of still another embodiment after etching.
Figure 11B:
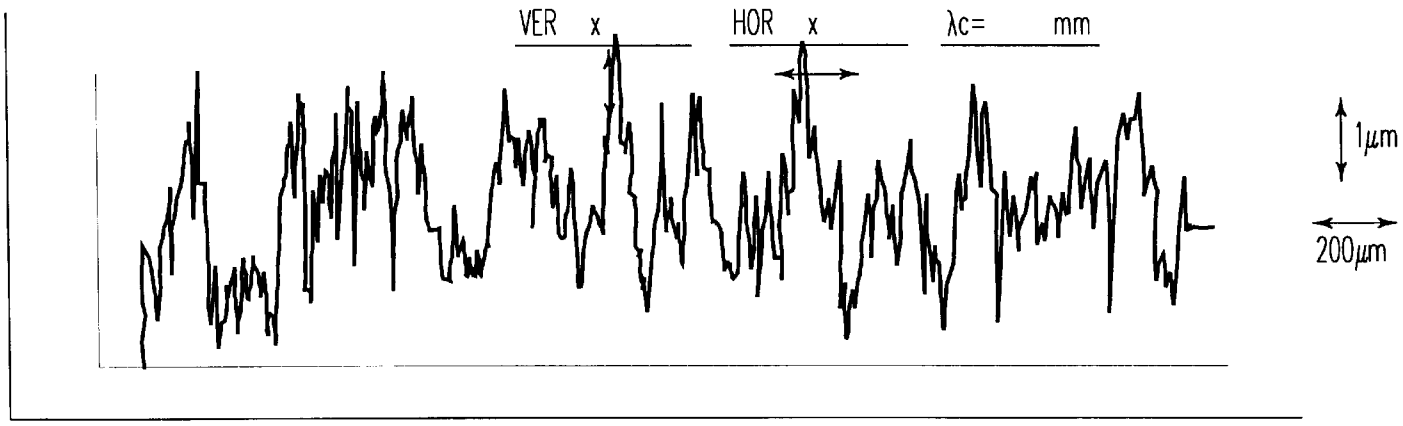

FIG. 11(9B60-*c*) shows a profile of irregularities on the center region of the substrate for another 9-inch model, which was burnished for about 60 minutes after etching. It shows rough irregularities as compared with the gentle irregularities indicated by the profile of irregularities shown in FIG. 10(9A60-*c*) and a state with fine irregularities slightly remained.

And, FIG. 11(12A-*b*) shows a profile of irregularities on the center region of the surface of the substrate undergone etching for about 15 minutes after pressing for a 12-inch model. It is seen that the substrate surface in this state has fine irregularities and etch pits larger in quantity than those shown in FIG. 9(9A-*b*).

Figure 12A:
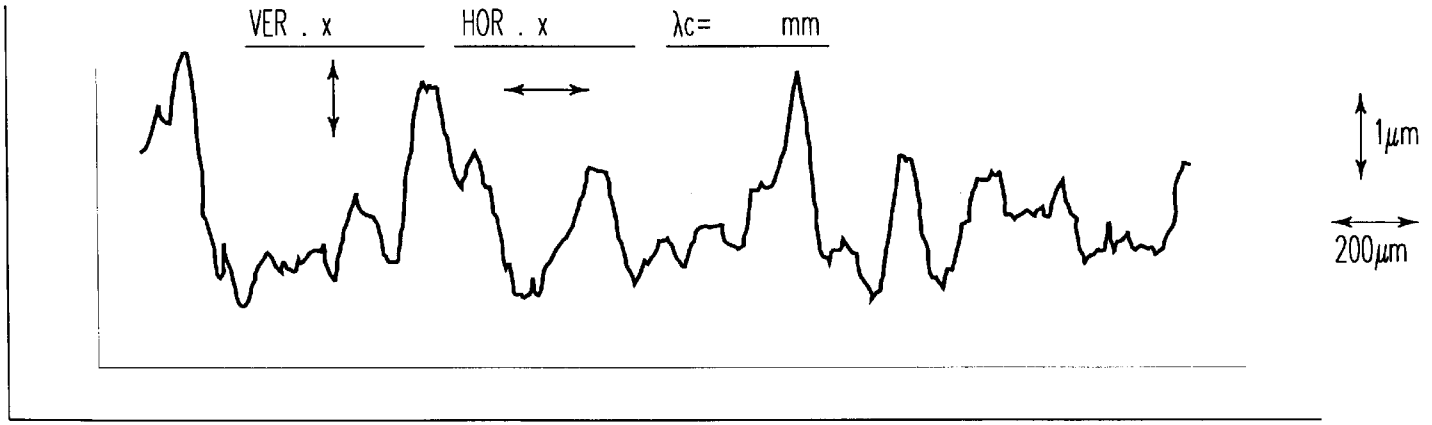
FIG. 12 shows graphs indicating the uneven surface profiles of the center and middle regions of the substrate of the invention after burnishing.
Figure 12B:
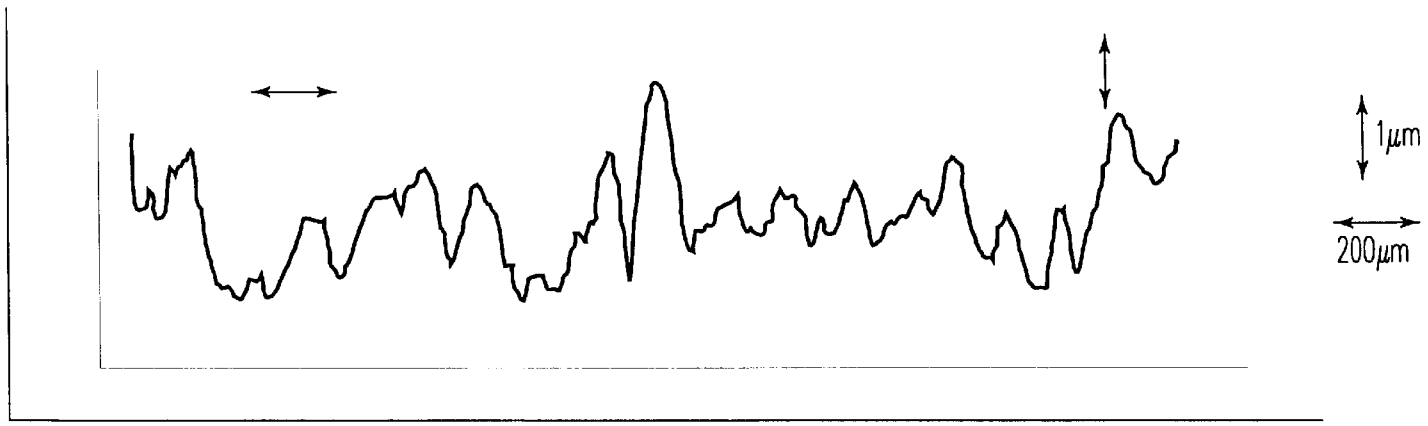

FIG. 12(12A30-*cc*) shows a profile of irregularities on the center region of the same substrate have undergone the burnishing for about 30 minutes. It is seen that the gentle irregularities which were formed by pressing appear substantially as they are, minute irregularities remain to some extent, and most of etch pits are filled.

Figure 13A:
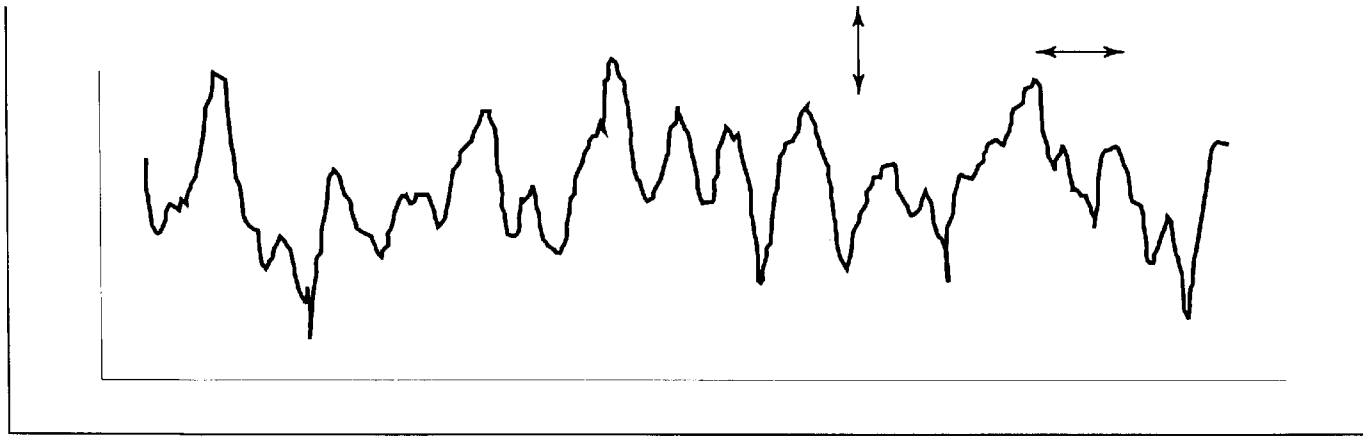
FIG. 13 shows graphs indicating the uneven surface profiles of the peripheral region of the substrate of the invention after burnishing and the center region of another substrate.
Figure 13B:
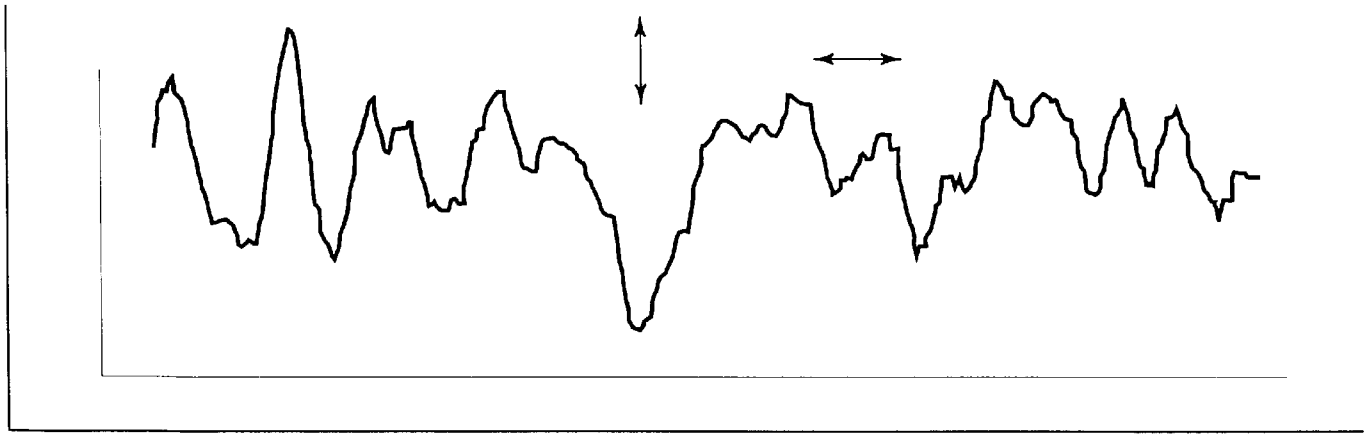
Figure 14A:
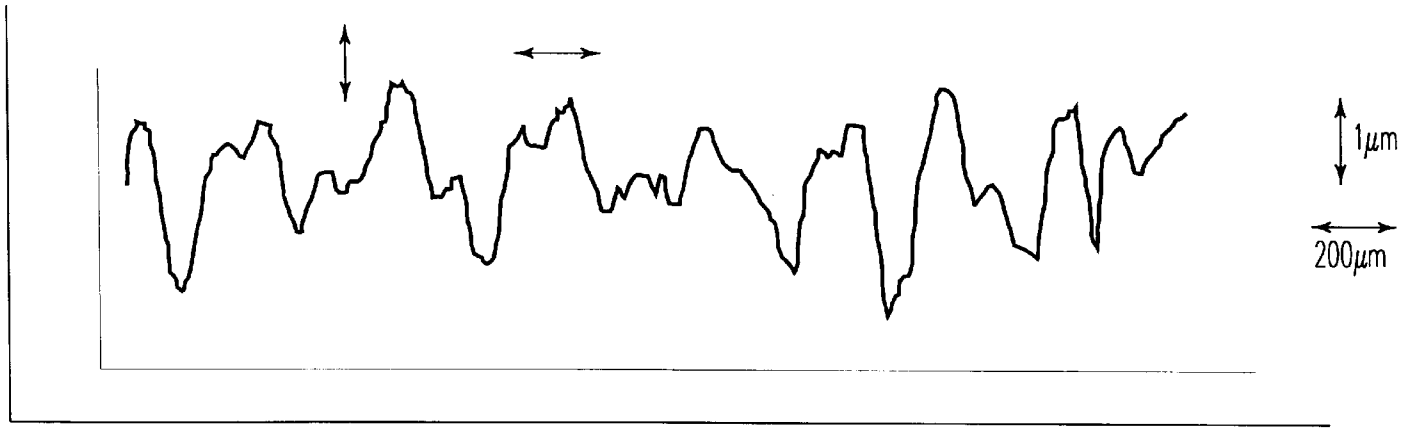
FIG. 14 shows graphs indicating the uneven surface profiles of the middle and peripheral regions of the substrate of the invention after burnishing.
Figure 14B:
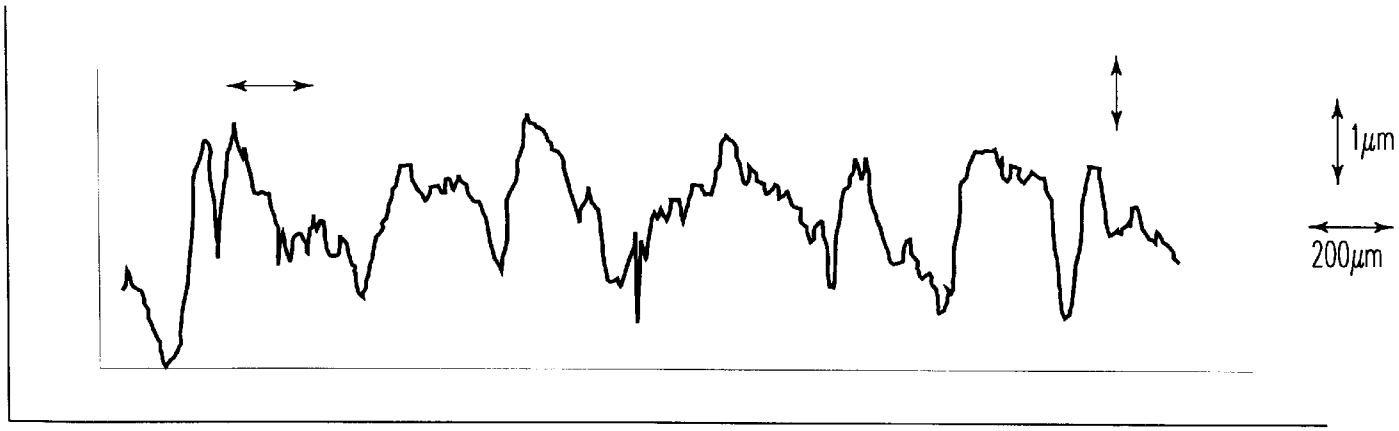

The profile of irregularities on the middle region of the same substrate as above is shown in FIG. 12(12A30-*cm*), and the profile of irregularities on the periphery region is shown in FIG. 13(12A30-*cp*). Upon comparing these profiles of irregularities on the center, middle and periphery regions, there is not a conspicuous difference among their states of irregularities.

Besides, another substrate for a 12-inch model undergone pressing and etching was burnished for about 60 minutes. Its profile of irregularities on the center region is shown in FIG. 13(12B60-*cc*), the profile of irregularities on the middle region in FIG. 14 (12B60-*cm*) and the profile of irregularities on the periphery region in FIG. 14(12B60-*cp*). Upon comparing them, it was seen that these regions have almost the same irregularities but minute irregularities remain slightly on the periphery region. It may be caused because a contact time between the substrate surface and the microballs for unit area of the substrate surface is short for the periphery region as compared with the center region. But, it was found that the presence of such minute irregularities does not noticeably degrade the resolution of the periphery region.

Figure 15A:
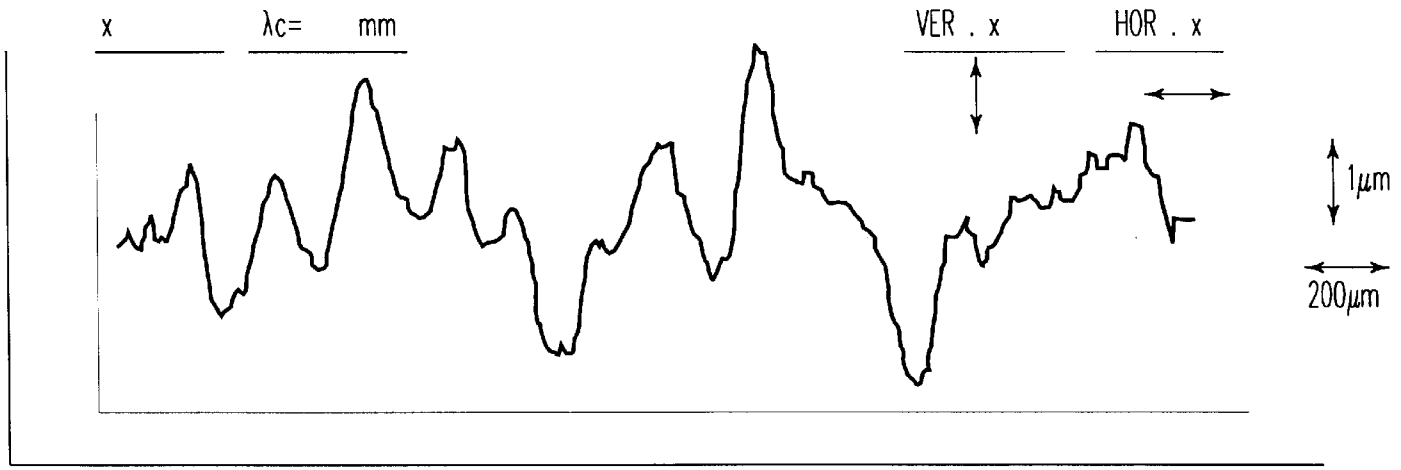
FIG. 15 shows graphs indicating the uneven surface profiles of the center and peripheral regions of another embodiment of the substrate of the invention after burnishing.
Figure 15B:
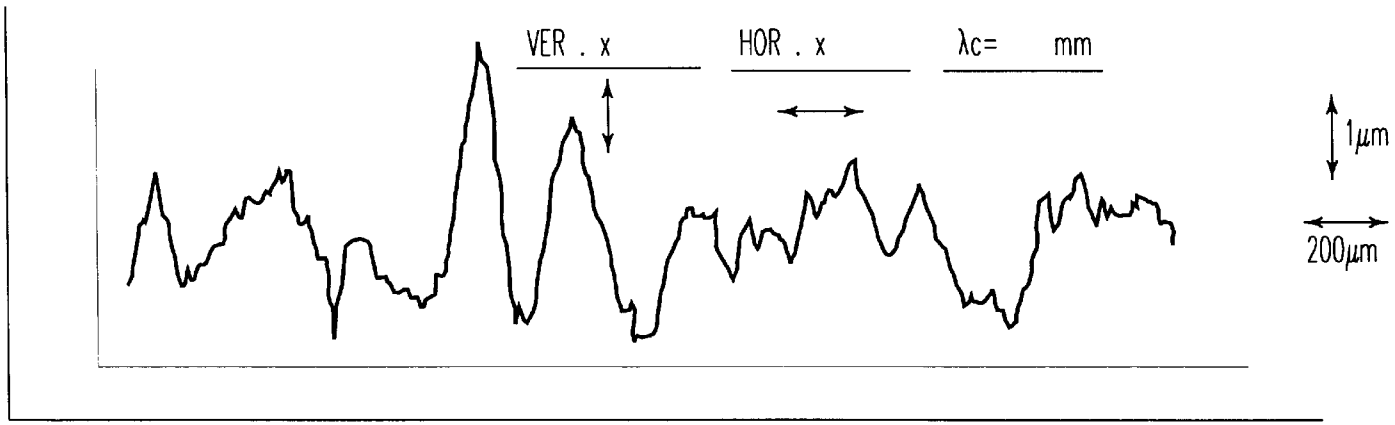

FIG. 15(16A60-*cc*) shows a profile of irregularities on the center region of a substrate for a 16-inch model, namely for an X-ray image intensifier larger than those described above, which was burnished for about 60 minutes after pressing and etching. FIG. 15(16A60-*cp*) shows a profile of irregularities on the periphery region of the same substrate. It is seen that these states of irregularities are almost same and minute irregularities remain slightly on the periphery region.

Comparison of the facts above clarifies that the minute irregularities are removed as the burnishing time is elongated, while the gentle irregularities caused by pressing remain almost as they are. According to the production method of the invention as described above, the irregularities having directivity and minute irregularities without directivity such as rolling lines were caused when the aluminum or aluminum alloy plate was rolled, the gentle irregularities without directivity were caused by the subsequent pressing, and the minute irregularities were caused by the subsequent etching. But, the minute irregularities on the substrate surface are mostly removed by the burnishing, and the smooth and gentle irregularities caused by pressing remain almost as they are on the face.

By comparing in various ways, it is assumed that the gentle irregularities caused by pressing the substrate originate in the crystalline structure of the substrate material, respective bottoms of the valleys of the profile of irregularities correspond to respective grain boundaries, and respective peaks correspond to the centers of the respective crystal grains. Therefore, such gentle irregularities do not seem removed by the burnishing process and remain without substantial change.

Accordingly, in the embodiments of the invention, the size of the gentle irregularities on the substrate surface, which were produced by pressing but not removed by burnishing, was measured with reference to the profile of irregularities suggested above. For example, the profile of irregularities on the center region of the substrate for a 12-inch model shown in FIG. 12 (12A30-*cc*) was measured and calculated. The results are shown in Table 1.

TABLE 1

Substrate for 12-inch model: Gentle irregularities on the center region after burnishing

| Order number between bottoms | Length between bottoms L (μm) | Height from peak to bottom H(μm) |
|---|---|---|
| 1 | 220 | 3.30 |
| 2 | 60 | 0.85 |
| 3 | 140 | 0.80 |
| 4 | 110 | 0.50 |
| 5 | 170 | 1.30 |
| 6 | 200 | 2.60 |
| 7 | 160 | 2.05 |
| 8 | 320 | 1.90 |
| 9 | 140 | 0.65 |
| 10 | 160 | 0.60 |
| 11 | 260 | 2.60 |
| 12 | 120 | 0.85 |
| 13 | 180 | 2.05 |
| 14 | 200 | 1.50 |
| 15 | 100 | 0.25 |
| 16 | 100 | 1.20 |
| 17 | 220 | 0.50 |
| 18 | 140 | 1.30 |
| Total length of bottom-to-bottom length or Total height from peak to bottom (μm) | 3000 | 24.80 |
| Average length L.ave (μm) or Average height H.ave(μm) | 167 | 1.38 |
| min (μm) | 60 | 0.25 |
| max (μm) | 320 | 3.30 |
| Numbers of bottoms | 18 | 18 |

Figure 16:
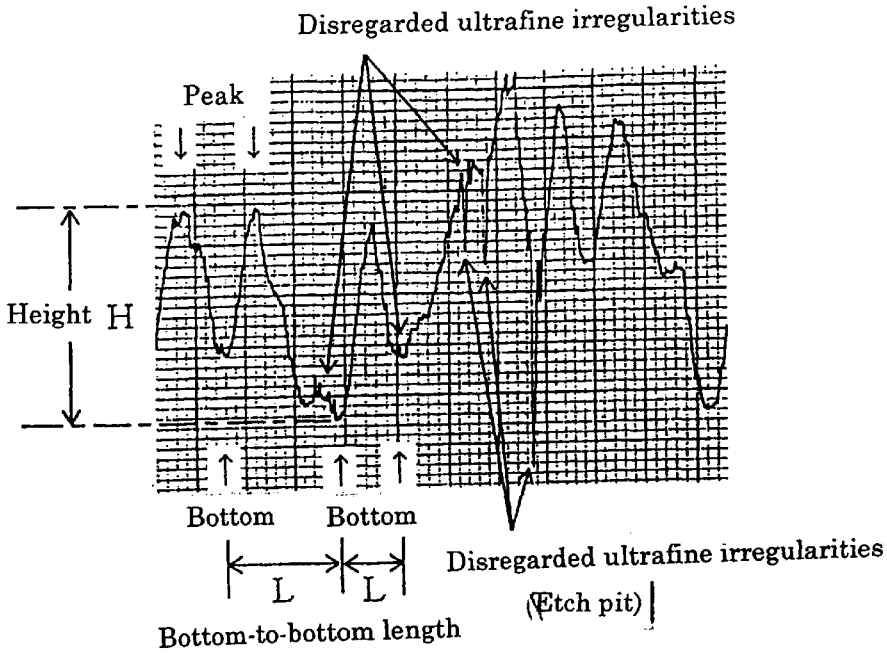
FIG. 16 is a graph illustrating a measuring and calculating method for irregularities in view of the irregular surface profile of the substrate of the invention.

The method of measuring the gentle irregularities in view of the profile of irregularities is performed as follows. Specifically, on the profile of irregularities obtained by measuring in a range of 2.0 mm to 4.0 mm in a given direction on the center region of the concave side of the substrate, a length L in the horizontal direction, i.e., the breadth direction, between a bottom and its right bottom, and a height H from the peak to the bottom (a larger height between those from the peak to the bottoms on its both sides) were measured in order from the left measurement starting point to the right measurement end as shown in FIG. 16. And, an average of bottom-to-bottom lengths L (determined as average length L.ave) and an average of heights (H) (determined as average height H.ave) were calculated.

Ultrafine irregularities practically falling in the following conditions were excluded from the measurement and calculation of the gentle irregularities. Specifically, the fine irregularities and etch pits locally seen on the gentle irregularities may be ignored generally. Therefore, ultrafine irregularities having a length L in the breadth direction between the neighboring bottoms of the irregularities is less than 20 μm and a height H of less than 0.2 μm and irregularities having a length in the breadth direction of less than 5 μm regardless of the magnitude of a height were excluded as shown in FIG. 16. A phosphor layer made of CsI has a light emission wavelength of about 0.41 μm, so that irregularities having a length or height smaller than its half wavelength of about 0.2 μm hardly cause irregular reflection of the emitted light and can be disregarded. These exclusion conditions were taken into consideration to make decision.

And, bottom-to-bottom lengths and heights were measured from the profiles of irregularities of the substrates for various diameters described above and shown in the drawings, and average values were calculated. The results are shown in Table 2.

TABLE 2

| Sample | Model (Inch) | Measured length (mm) | Number of irregularities (Quantity) | Bottom-to-bottom length L (μm) Average L. ave | min | max | Height between peak to bottom H (μm) Average H ave | min | max |
|---|---|---|---|---|---|---|---|---|---|
| 1, (9A) | 9 | 3.6 | 35 | 103 | 60 | 210 | 0.58 | 0.15 | 1.25 |
| 2, (9B) | 9 | 2.9 | 19 | 153 | 60 | 280 | 2.20 | 0.50 | 4.30 |
| 3, (12A) | 12 | 3.0 | 18 | 167 | 60 | 320 | 1.38 | 0.25 | 3.30 |
| 4, (12B) | 12 | 3.0 | 15 | 200 | 80 | 290 | 1.74 | 0.25 | 3.30 |
| 5, (16A) | 16 | 2.9 | 12 | 215 | 70 | 550 | 1.97 | 0.50 | 4.30 |

The diameter of the substrate, namely the diameter of the region formed on the curved face of the substrate and the radius of curvature of the center region generally become large in the sizes in order of 9 inch model, 12 inch model and 16 inch model.

It is seen from the above that the sizes of gentle irregularities caused on the substrate by pressing are not conspicuously different among the center region, the middle region and the periphery region but depend on the diameter size, namely the diameter of the region formed on the curved face of the substrate or the size of the radius of curvature of the center region. It may be caused due to its dependency on a degree of plastic deformation of the substrate material by pressing.

Ratios of diameter sizes, radiuses of curvature, average lengths (L.ave) between the neighboring bottoms were calculated to result as shown in Table 3.

TABLE 3

| Sample | Model (Inch) | Average length L ave (μm) | Diameter D (mm) | Radius of curvature of center region Rc (mm) | Average length/ diameter L. ave (μm)/D (mm) | Average length/ radius of curvature L. ave (μm)/Rc (mm) |
|---|---|---|---|---|---|---|
| 1, (9A) | 9 | 103 | 250 | 140 | 0.41 | 0.74 |
| 2, (9B) | 9 | 153 | 250 | 140 | 0.61 | 1.09 |
| 3, (12A) | 12 | 167 | 330 | 200 | 0.51 | 0.84 |
| 4, (12B) | 12 | 200 | 330 | 200 | 0.61 | 1.00 |
| 5, (16A) | 16 | 215 | 420 | 210 | 0.51 | 1.02 |

It is seen from the table that the gentle irregularities 21*c* caused on the substrate by pressing have an average of lengths L of 100 to 220 μm between the neighboring bottoms of the profile of irregularities and an average of heights H of about 0.6 to 2.2 μm from the peaks to the bottoms. Such gentle irregularities 21*c* on the substrate surface forming the input screen are useful to enhance an adhesiveness of the input screen, and the bottom of the profile of irregularities, namely the concave side, serve as a concave mirror.

As described above, an average of diameters d of columnar crystals P configuring the input phosphor layer is in a range of about 6 to 10 μm. Therefore, an average length L.ave between the neighboring bottoms of the gentle irregularities caused on the substrate by pressing is several times greater than the average diameter of the columnar crystals P of the phosphor layer.

Therefore, if the average diameter of columnar crystals P configuring the input phosphor layer is, for example, about 10 μm and a pitch of the gentle irregularities on the substrate surface, namely the bottom-to-bottom length, is about 100 μm, it means that about 100 columnar crystals P are formed as aggregates on a single concave side of such gentle irregularities.

When X-rays enter the input of the X-ray image intensifier configured as described above, the X-rays penetrate the substrate and are converted into light on the phosphor layer. And, part of the light converted on the phosphor layer advances in the direction of the substrate and reflects as indicated by an arrow Y in FIG. 5 on the substrate or the optically reflective layer face deposited thereon. Since substantially no minute irregularities are on the substrate surface, diffused reflection in the irregular directions on the substrate surface is small, a possibility of returning to the original columnar crystals becomes high, and resolution of the X-ray image intensifier is improved.

Besides, each concave side of the gentle irregularities of the substrate functions like a concave mirror so that light reflected on each concave side enters the columnar crystals of the same aggregate formed on the common concave side to go back. As a result, MTF in the spatial frequency region, which corresponds to a bottom-to-bottom length of the gentle irregularities on the substrate surface, namely an irregularity pitch, is also improved.

In view of above, with the practically used X-ray image intensifiers having various diameter sizes taken into account, when the input screen-forming face of the substrate is measured in view of the profiles of irregularities under the following measuring conditions, it preferably has the gentle irregularities that an average length between the neighboring bottoms of the irregularities is in a range of 50 μm to 300 μm and an average height between the peak and the bottom is in a range of 0.3 μm to 4.0 μm. And, more preferably, the average length between the neighboring bottoms is in a range of 80 μm to 250 μm, and the average height from the peak to the bottom is in a range of 0.4 μm to 3.0 μm.

And, a ratio (L.ave/D) of the average length L.ave (unit: μm) between the neighboring bottoms of the gentle irregularities described above to the diameter D (unit: mm) of the region formed on the concave side of the substrate is preferably in a range of 0.35 to 0.65.

Besides, a ratio (L.ave/Rc) of the bottom-to-bottom length L.ave (unit: μm) to the radius of curvature Rc (unit: mm) is preferably in a range of 0.7 to 1.1.

Meanwhile, it is apparent from the above description that in the burnishing processing of the substrate surface, a degree of removing the minute projections and etch pits can be decreased in the order of the center region, the middle region and the periphery region by decreasing a rolling contact duration of the microballs per unit area in the order of, for example, the center region, the middle region and the periphery region of the substrate. Therefore, for example brightness uniformity of the output image of the X-ray image intensifier can be improved.

Figure 17:
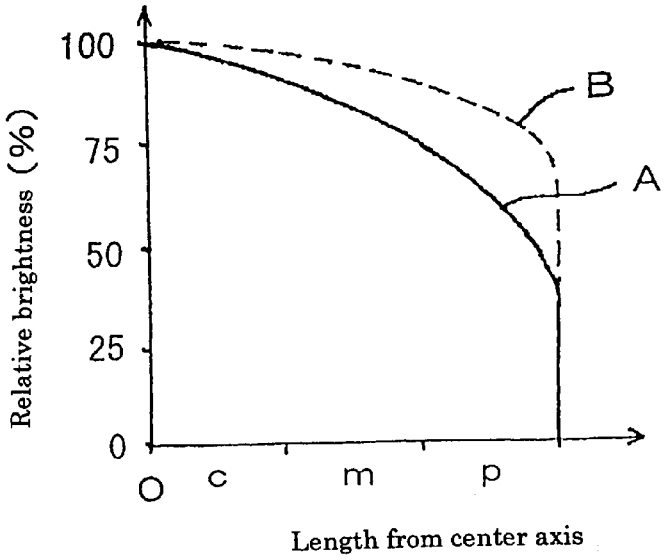
FIG. 17 is a graph illustrating distribution of brightness on an output screen according to prior art and the present invention.

In this connection, it is ascertained that brightness from the center to the periphery of the output visible ray image of the X-ray image intensifier has the relation as shown in FIG. 17. The horizontal axis of FIG. 17 indicates a length in a radial direction from the center axis O of the output image corresponding to the center axis of the substrate, and the vertical axis indicates relative brightness with the center O determined as 100%. Curve A indicates an output brightness distribution of the X-ray image intensifier having a conventional substrate surface with an irregular reflection rate of about 20% and a specular reflection rate of about 35%. Meanwhile, curve B indicates an output brightness distribution of the X-ray image intensifier having a substrate surface similar to the embodiments of the invention with an irregular reflection rate of about 30% and a specular reflection rate of about 95% on the periphery region. The irregular and specular reflection rates of the curves A and B are relative values determined when the center axis of the substrate is determined as 100%. And, it is assumed that a light-emitting efficiency of the output screen is uniform on all regions.

The irregular reflection rate is defined by a relative value obtained when white powder is determined as 100% at a ratio that light, which perpendicularly enters the substrate surface, reflects in a direction at least 2.5 degrees away from a nominal line perpendicular to a reflection point. And, the specular reflection rate is defined by a relative value obtained when a mirror face is determined as 100% at a ratio that light reflects in a direction at less than 2.5 degrees away from a line perpendicular to the reflection point. Therefore, when the substrate surface has a minute irregular surface, the irregular reflection rate is high; brightness of the output screen obtained from the input screen formed thereon becomes high. On the other hand, when the substrate surface does not have the fine irregularities and is similar to a mirror face, the specular reflection rate becomes high, and a ratio of light quantity, which reaches the photocathode through a light guide section formed of the columnar crystals, to the total quantity of emitted light increases, and resolution is improved.

It is seen from the comparison of the curves A and B of FIG. 17 that the conventional curve A with a low irregular reflection rate and specular reflection rate has brightness on the periphery decreased, and brightness uniformity degraded. On the other hand, the curve B of the present invention, which increases the specular reflection rate of the substrate surface as the whole and suppresses the irregular reflection rate on the periphery from lowering, indicates that both brightness uniformity and resolution can be improved.

Accordingly, by burnishing the entire region from the center to the periphery of the substrate surface by the burnishing device described above taking a sufficient time, the specular reflection rate on the substrate surface becomes high as the whole and resolution is improved. And, the contacting duration between the substrate surface and the microballs per unit area is relatively short on the periphery region as compared with the center region of the substrate. Otherwise, the inclination angle of the rotating substrate is adjusted so that quantity of burnishing on the periphery region becomes smaller than on the center region. Thus, the irregular reflection rate's lowering can be suppressed to be small with the minute irregularities remained to some extent on the periphery region to prevent brightness on the periphery from being decreased. As a result, resolution on the periphery region is improved less than on the center, but the effect of improving the brightness can be enhanced, and resolution and brightness uniformity on the output screen can be improved.

Figure 18:
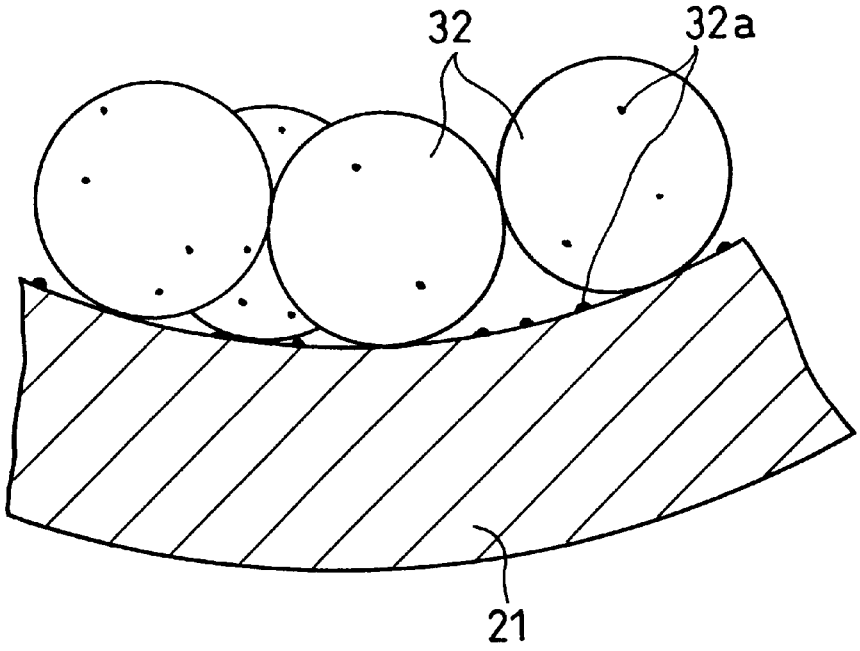
FIG. 18 is an enlarged sectional view showing main parts in a burnishing step of another embodiment of the invention.

The embodiment shown in FIG. 18 indicates a method of mixing a small amount of aluminum or magnesium fine grains 32*a* with microballs 32 of stainless steel and burnishing. In this method, the fine grains 32*a* adhere to the surface of the substrate 21 by burnishing to smooth the substrate surface in a relatively short time. This is probably achieved because some of the adhered fine grains are gradually crushed and expanded, the minute projections on the substrate surface are crushed, and the recessed spots including etch pits are filled with the fine grains. Therefore, the specular reflection rate on the substrate surface is enhanced and the irregular reflection rate is decreased by burnishing for an appropriate time.

Accordingly, by adopting this method to burnish mainly the center region of the substrate, resolution of the center region can be enhanced, and the brightness uniformity of the entire screen can also be improved with the brightness of the center region suppressed to some extent. By this method, the burnishing time can be made shorter than in the previous embodiment. And, if the fine grains remain in an easily removable state on the substrate surface after the process, they are removed by cleaning.

Figure 19:
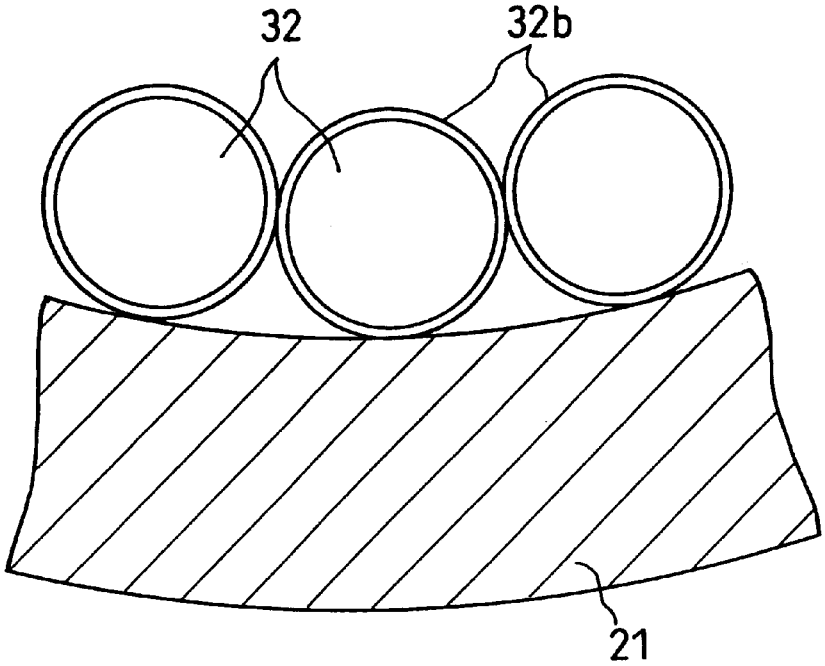
FIG. 19 is an enlarged sectional view showing main parts in a burnishing step of still another embodiment of the invention.
Figure 20:
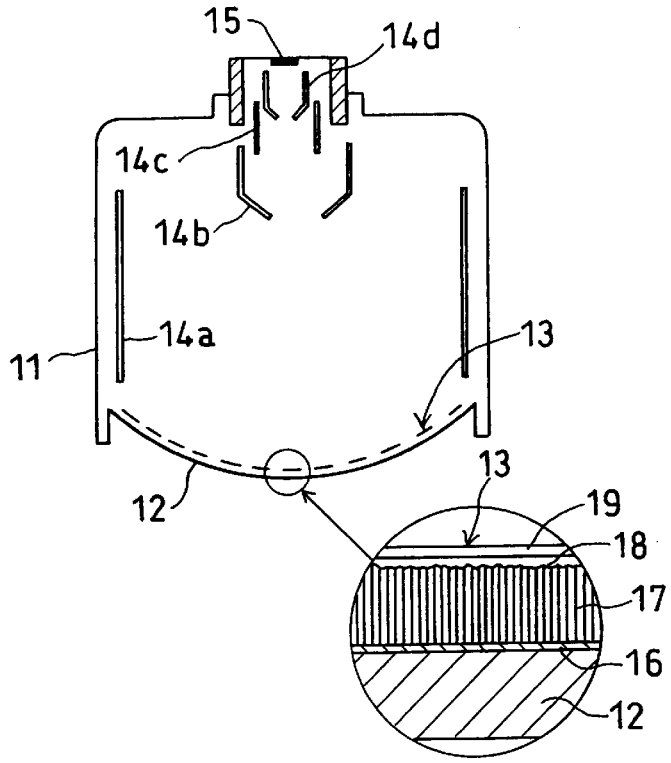
FIG. 20 is a partly enlarged schematic sectional view showing the structure of a general X-ray image intensifier.

FIG. 19 shows an embodiment of burnishing using the microballs 32 of stainless steel which have a thin layer 23*b* of aluminum or magnesium deposited on their surfaces. According to this method, the layers 32*b* of the microballs are rubbed against the substrate surface to gradually smooth in the same way as in the embodiment shown in FIG. 18, thereby providing the same functions and effects. In this case, the effects are satisfactory when the layer has a thickness of 500 angstroms or more.

For example, metallic microballs of stainless steel are obtained with less surface irregularities, while ceramics microballs generally have slightly larger surface irregularities. When such ceramics microballs are used for burnishing, the substrate surface is slightly shaved to adhere aluminum grains to the surfaces of these balls, and these aluminum grains gradually adhere into the fine recesses on the substrate surface to smooth it. Therefore, the ceramics microballs can be used as required to provide a surface with desired irregularities. However, if the microballs have a surface with irregularities of 5 μm or more, it becomes hard to decrease or remove the minute irregularities on the substrate surface. Therefore, the microballs preferably have surface irregularities of 5 μm or below, more preferably 3 μm or below.

Besides, the burnishing may be performed by a method that the substrate surface is first processed by the stainless steel microballs, and the center region is then mainly processed by the ceramics microballs. And, multiple types of microballs having different surface irregularities may be used in combination or separately for burnishing.

Furthermore, if the burnishing is continued for a long time, the minute irregularities on the substrate surface can be removed temporarily, but countless ultrafine scratches are gradually caused on the substrate surface by the microballs. The substrate surface having such scratches shows a black and glitter state. This surface has a low irregular reflection rate and a high specular reflection rate. Therefore, this substrate provides an output screen having low brightness and high resolution. Accordingly, by taking a sufficient time for burnishing the center region and gradually decreasing the burnishing time for the middle region and the periphery region in this order, the irregular reflection rate is gradually increased from the center to the periphery, so that good brightness uniformity can be obtained.

As described above, the present invention prevents resolution from being decreased and improves further the brightness uniformity as required with the adhesiveness of the input phosphor layer to the substrate maintained and achieves the X-ray image intensifier in which image noises caused due to the substrate surface condition are decreased.

What is claimed is:

1. An X-ray image intensifier, comprising a substrate of aluminum or aluminum alloy pressed to have a substantially spherical shape with a concave surface and an input screen having an X-ray excited phosphor layer which is formed of an aggregate of columnar crystals disposed on the concave surface and a photocathode disposed on the phosphor layer, wherein:

the concave surface of the substrate has gentle irregularities having substantially no directivity, and when the gentle irregularities are measured for their profile by a measurement given below, an average length between the bottoms of the neighboring irregularities is in a range of 50 μm to 300 μm, and an average height from peaks to bottoms of the neighboring irregularities in a range of 0.3 μm to 4.0 μm;

where the measurement determines an average length between the neighboring bottoms in the horizontal direction and an average height from peaks to bottoms from a profile of irregularities obtained by linearly measuring in a range of 2.0 mm to 4.0 mm in a given direction on the center region of the concave surface of the substrate; but minute irregularities which have a length of less than 20 μm between the neighboring bottoms in the horizontal direction and a height of less than 0.2 μm from peaks to bottoms and minute irregularities which have a length of 5 μm or below in the horizontal direction regardless of the height are excluded from the peaks or bottoms for measuring.

2. The X-ray image intensifier as set forth in claim 1, wherein the columnar crystals of the X-ray excited phosphor layer have an average diameter in a range of 6 μm to 10 μm.

3. The X-ray image intensifier as set forth in claim 1, wherein the average length between the neighboring bottoms is smaller on the periphery region than on the center region of the substrate.

4. The X-ray image intensifier as set forth in claim 1, wherein the gentle irregularities of the substrate surface have minute irregularities having a length of 40 μm or below between the neighboring bottoms, and the minute irregularities are more on the periphery region than on the center region of the substrate.

5. The X-ray image intensifier as set forth in claim 1, wherein the substrate is made of aluminum alloy and also serves as an X-ray input window of a vacuum envelope, and the input screen is formed on the concave surface of the substrate.

6. An X-ray image intensifier, comprising a substrate of aluminum or aluminum alloy pressed to have a substantially spherical shape with a concave surface and an input screen having an X-ray excited phosphor layer which is formed of an aggregate of columnar crystals disposed on the concave surface and a photocathode disposed on the phosphor layer, wherein a ratio (L.ave/D) of an average length L.ave (unit: μm) between the neighboring bottoms of the gentle irregularities to a diameter D (unit: mm) of a region having the concave side of the substrate is in a range of 0.35 to 0.65;

where the measurement determines an average length between the neighboring bottoms in the horizontal direction and an average height from peaks to bottoms from a profile of irregularities obtained by linearly measuring in a range of 2.0 mm to 4.0 mm in a given direction on the center region of the concave surface of the substrate; but minute irregularities which have a length of less than 20 μm between the neighboring bottoms in the horizontal direction and a height of less than 0.2 μm from peaks to bottoms and minute irregularities which have a length of 5 μm or below in the horizontal direction regardless of the height are excluded from the peaks or bottoms for measuring.

7. The X-ray image intensifier as set forth in claim 6, wherein a ratio (L.ave/Rc) of the average length L.ave (unit: μm) between the neighboring bottoms to a radius of curvature Rc (unit: mm) of the concave surface of the center region of the substrate is in a range of 0.7 to 1.1.

8. An X-ray image intensifier, comprising a substrate of aluminum or aluminum alloy pressed to have a substantially spherical shape with a concave surface and an input screen having an X-ray excited phosphor layer which is formed of an aggregate of columnar crystals disposed on the concave surface and a photocathode disposed on the phosphor layer, wherein the concave surface of the substrate on which the input screen is formed has an irregular reflection rate higher on the periphery region than on the center region.

9. A method of manufacturing an X-ray image intensifier comprising:

a pressing step for pressing an aluminum or aluminum alloy substrate material into a substantially spherical shape with a concave surface;

a burnishing step for crushing minute projections of the concave surface of the pressed substrate; and an input screen forming step for depositing an X-ray excited phosphor layer formed of an aggregate of columnar crystals on to the concave surface of the substrate and depositing a photocathode on the phosphor layer.

10. The method of manufacturing an X-ray image intensifier as set forth in claim 9, wherein the burnishing step crushes the minute projections which are smaller than gentle irregularities, which have a length of 50 μm or more between the neighboring bottoms, caused by the pressing step of the substrate.

11. The method of manufacturing an X-ray image intensifier as set forth in claim 9, wherein the burnishing step includes a step of crushing the minute projections on the concave surface by continuously rolling microballs on the concave surface of the substrate formed by the pressing step.

12. The method of manufacturing an X-ray image intensifier as set forth in claim 11, wherein the microballs used in the burnishing step are made of metal or ceramics having a Vickers hardness two times or more larger than a Vickers hardness of the substrate.

13. The method of manufacturing an X-ray image intensifier as set forth in claim 11, wherein the microballs have an average diameter in a range of 0.3 mm to 3.0 mm.

14. The method of manufacturing an X-ray image intensifier as set forth in claim 9, wherein the burnishing step has a shorter burnishing time per unit area on the periphery region than on a center region of the concave surface of the substrate.

15. The method of manufacturing an X-ray image intensifier as set forth in claim 11, wherein the burnishing step uses microballs mixed with aluminum or magnesium powder.

* * * * *